US007524222B2

(12) United States Patent
Ochiai

(10) Patent No.: US 7,524,222 B2
(45) Date of Patent: Apr. 28, 2009

(54) REMOTE CONTROL SYSTEM FOR MARINE DRIVE

(75) Inventor: Katsumi Ochiai, Hamamatsu (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/795,765

(22) Filed: Mar. 8, 2004

(65) Prior Publication Data

US 2004/0198109 A1 Oct. 7, 2004

(30) Foreign Application Priority Data

Mar. 6, 2003 (JP) ..... 2003-059995
Jan. 16, 2004 (JP) ..... 2004-008850

(51) Int. Cl.
*B60W 10/04* (2006.01)

(52) U.S. Cl. ..... 440/84; 440/86; 440/87

(58) Field of Classification Search ..... 440/84–87
See application file for complete search history.

(56) References Cited

U.S. PATENT DOCUMENTS 5,051,102 A 9/1991 Onoue
5,094,122 A * 3/1992 Okita ..... 74/480 B
5,167,212 A * 12/1992 Peter et al. ..... 123/399
5,429,087 A 7/1995 Tsujino et al.
5,431,141 A 7/1995 Kanazawa et al.
5,595,159 A * 1/1997 Huber et al. ..... 123/362
5,741,166 A * 4/1998 Newman ..... 440/84
5,749,343 A * 5/1998 Nichols et al. ..... 123/350
6,015,319 A 1/2000 Tanaka
6,058,349 A * 5/2000 Kikori et al. ..... 701/114
6,073,509 A * 6/2000 Salecker et al. ..... 74/335
6,485,340 B1 * 11/2002 Kolb et al. ..... 440/84
6,675,733 B2 * 1/2004 Hoshina ..... 114/144 A

FOREIGN PATENT DOCUMENTS

JP 07-247868 9/1995
JP 2001-260986 9/2001

OTHER PUBLICATIONS

Co-pending U.S. Appl. No. 10/619,095, filed Jul. 11, 2003. Title: Multiple Node Network and Communication Method Within the Network. Inventor: Okuyama, Takashi.
Co-pending U.S. Appl. No. 10/689,343, filed Oct. 20, 2003. Title: Shift Device for Marine Transmission. Inventor: Ochiai, Katsumi et al.

* cited by examiner

*Primary Examiner*—Ed Swinehart
(74) *Attorney, Agent, or Firm*—Knobbe, Martens, Olson & Bear, LLP

(57) ABSTRACT

A remote control system for a marine drive includes a change element that changes an operational condition of the marine drive. An actuator actuates the change element. An ECU controls the actuator. A remote controller is remotely placed from the ECU. The remote controller has a control lever. A mechanical cable has ends. One end is coupled with the control lever. A potentiometer outputs a command signal to the ECU. The potentiometer has an input lever. Another end of the mechanical cable is coupled with the input lever. The input lever moves along with the control lever when the control lever is operated. The potentiometer generates the command signal in accordance with a position of the input lever. The control device controls the actuator based upon the command signal.

18 Claims, 8 Drawing Sheets

REMOTE CONTROL SYSTEM FOR MARINE DRIVE

PRIORITY INFORMATION

The present application is based on and claims priority under 35 U.S.C. § 119 to Japanese Patent Applications No. 2003-059995, filed on Mar. 6, 2003; and No. 2004-008850, filed on Jan. 16, 2004, the entire contents of both of which are expressly incorporated by reference herein.

BACKGROUND OF THE INVENTIONS

1. Field of the Inventions

The present inventions generally relate to a remote control system for a marine drive, and more particularly to an improved remote control system that controls an operational condition of a marine drive.

2. Description of Related Art

Marine drives such as, for example, outboard motors are typically disposed at a stern of an associated watercraft. Such outboard motors incorporate a propulsion device with a propeller for propelling the watercraft. An internal combustion engine typically is used to drive the propeller.

Typically, the engine has one or more throttle valves that regulate an amount of air delivered to one or more combustion chambers of the engine. A remote controller typically is placed in a cockpit of the watercraft to remotely operate the throttle valves. Such a remote controller typically has a lever pivotally affixed to a housing of the remote controller. The lever is connected to a throttle valve link including a throttle cable, for example, such that a driver can remotely operate the throttle valves. The throttle valve link can simultaneously move all the throttle valves. In some arrangements, the cable also connects the remote controller with a shift mechanism that changes the propeller among forward, neutral and reverse modes.

Recently, new control systems have replaced mechanical cables with electronic components starts replacing such a conventional mechanical control system. The new control system is an electrical control system that has, for example, a position sensor that senses a position of the lever, an actuator that actuates the throttle link, and a control device that controls the actuator based upon an output of the position sensor. That is, the throttle link is electrically operated through those components. For example, Japanese Patent Publication 2001-260986A discloses such an electrical control system.

A user of the watercraft can select either a watercraft adapted to the mechanical control system or a watercraft adapted to the electrical control system. Normally, watercrafts shipped from factories are equipped with a remote controller that is adapted to the mechanical control system. In order to provide the options, therefore, at least two types of outboard motors are necessary on the market, one adapted to the mechanical control system and another adapted to the electrical control system. This is more burdensome for manufactures of such outboard motors.

SUMMARY OF THE INVENTIONS

In accordance with one embodiment, a control system for a marine drive comprises a change element that changes an operational condition of the marine drive. An actuator is arranged to actuate the change element. A control device is configured to control the actuator. An operative device is disposed remotely from the control device. The operative device has a first movable member. A mechanically connecting member has a plurality of ends. One end of the connecting member is coupled with the first movable member. A signal generator is configured to output a command signal to the control device. The signal generator has a second movable member. Another end of the connecting member is coupled with the second movable member. The second movable member moves along with the first movable member when the first movable member is operated. The signal generator generates the command signal in accordance with a position of the second movable member. The control device controls the actuator based upon the command signal.

In accordance with another embodiment, a control system for a marine drive that has an engine comprises a throttle valve that regulates an amount of air to a combustion chamber of the engine. A throttle valve actuator is arranged to actuate the throttle valve. A control device is configured to control the throttle valve actuator. An operative device is disposed remotely from the control device. The operative device has a first movable member. A mechanically connecting member has a plurality of ends. One end of the connecting member is coupled with the first movable member. A signal generator is configured to output a command signal to the control device. The signal generator has a second movable member. Another end of the connecting member is coupled with the second movable member. The second movable member moves along with the first movable member when the first movable member is operated. The signal generator generates the command signal in accordance with a position of the second movable member. The control device controls the throttle valve actuator based upon the command signal.

In accordance with a further embodiment, a control system for a marine drive comprises a change element that changes an operational condition of the marine drive. An actuator is arranged to actuate the change element. A control device is configured to control the actuator. A first operative arrangement is configured to communicate with the control device. The first operative assortment includes a first operative device disposed remotely from the control device. A signal generator is configured to output a first command signal to the control device. The first operative device has a first movable member. A mechanical connecting member has a plurality of ends. A first end of the connecting member is coupled with the first movable member. The signal generator has a second movable member. A second end of the connecting member is coupled with the second movable member. The second movable member moves along with the first movable member when the first movable member is operated. The signal generator generates the first command signal in accordance with a position of the second movable member. A second operative arrangement is configured to communicate with the control device. The second operative assortment includes a second operative device that has a third movable member. A position sensing device senses a position of the third movable member. The position sensing device is configured to output a second command signal to the control device. The signal generator and the position sensing device are selectively connected to the control device. The control device controls the actuator based upon either the first or second command signal.

In accordance with yet another embodiment, a control system for a marine drive comprises a change element that changes an operational condition of the marine drive. An actuator is arranged to actuate the change element. A control device is configured to control the actuator. An operative device is disposed remotely from the control device. The operative device has a movable member. A signal generator is configured to output a command signal to the control device. Means are provided for mechanically connecting the movable member to the signal generator. The signal generator generates the command signal in response to a movement of the movable member. The control device controls the actuator based upon the command signal.

In accordance with another embodiment, a control system for a marine drive that has an engine comprises a throttle valve that regulates an amount of air to a combustion chamber of the engine. A throttle valve actuator is arranged to actuate the throttle valve. A control device is configured to control the throttle valve actuator. An operative device is disposed remotely from the control device. The operative device has a movable member. A signal generator is configured to output a command signal to the control device. Means are provided for mechanically connecting the movable member to the signal generator. The signal generator generates the command signal in response to a movement of the movable member. The control device controls the throttle valve actuator based upon the command signal.

In accordance with a further embodiment, a watercraft comprises a hull. A marine drive is arranged to propel the hull. A change element changes an operational condition of the marine drive. An actuator is arranged to actuate the change element. A control device is configured to control the actuator. An operative device is disposed remotely from the control device. The operative device has a first movable member. A mechanical connecting member has a plurality of ends. A first end of the connecting member is coupled with the first movable member. A signal generator is configured to output a command signal to the control device. The signal generator has a second movable member. A second end of the connecting member is coupled with the second movable member. The second movable member moves along with the first movable member when the first movable member is operated. The signal generator generates the command signal in accordance with a position of the second movable member. The control device controls the actuator based upon the command signal.

In accordance with another embodiment, a watercraft comprises a hull. A marine drive is arranged to propel the hull. The marine drive includes an engine that has a throttle valve arranged to regulate an amount of air to a combustion chamber of the engine. An actuator is arranged to actuate the throttle valve. A control device is configured to control the actuator. An operative device is disposed remotely from the control device. The operative device has a first movable member. A mechanical connecting member has a plurality of ends. A first end of the connecting member is coupled with the first movable member. A signal generator is configured to output a command signal to the control device. The control device controls the actuator based upon the command signal. The signal generator has a second movable member. A second end of the connecting member is coupled with the second movable member. The second movable member moves along with the first movable member when the first movable member is operated. The signal generator generates the command signal in accordance with a position of the second movable member.

In accordance with another embodiment, a method is provided for controlling a marine drive. The method comprises selecting a first control system that mechanically transmits a movement of a first movable member to a signal generator that generates a first command signal or a second control system that has a position sensing device sensing a position of a second movable member to generate a second command signal, and controlling an actuator that actuates a change element based upon either the first or second command signal. The change element changes the operational condition of the marine drive.

BRIEF DESCRIPTION OF THE DRAWINGS

The foregoing and other features, aspects and advantages of the present invention are described in detail below with reference to the drawings of a preferred embodiment which is intended to illustrate and not to limit the invention. The drawings comprise eight figures in which.

DETAILED DESCRIPTION OF THE PREFERRED EMBODIMENT OF THE INVENTIONS

Figure 1:
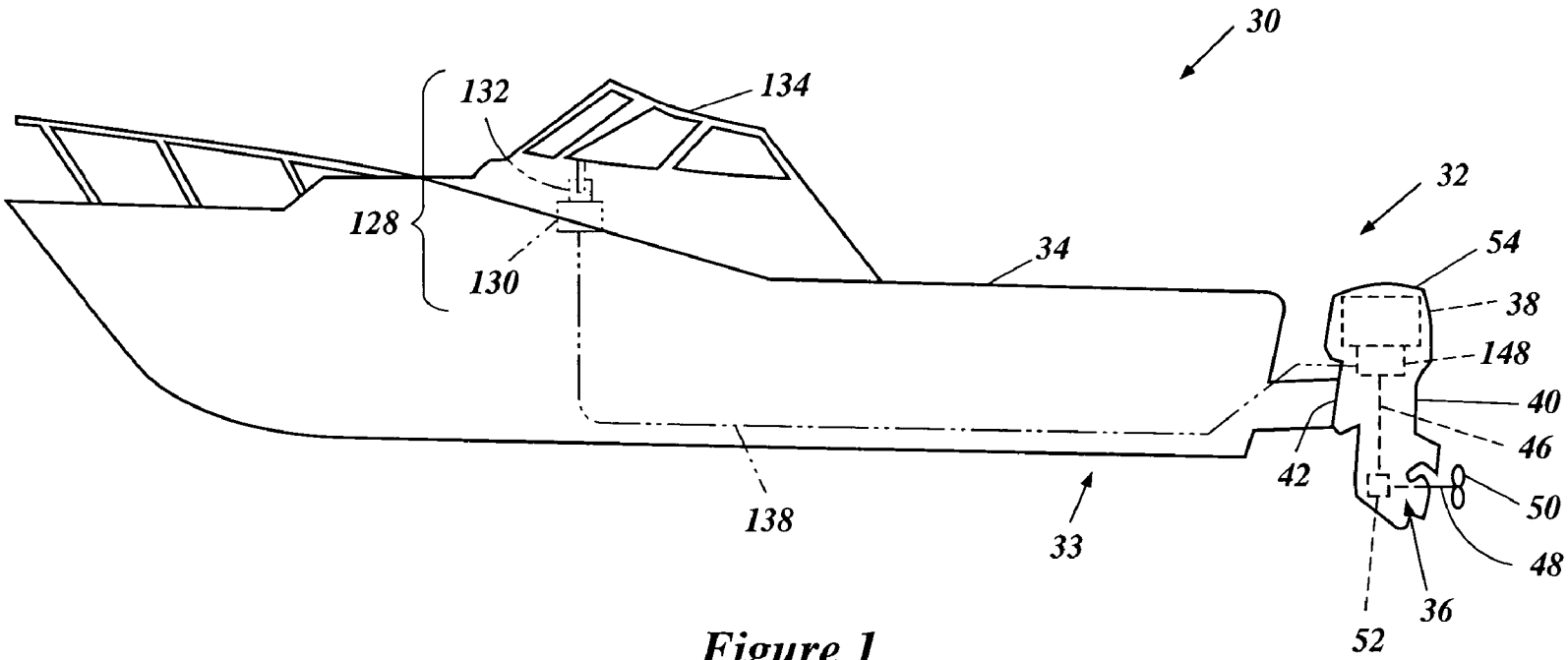
FIG. 1 illustrates a schematic representation of a port side elevational view of a watercraft having a hybrid control system configured in accordance with certain features, aspects and advantages of an embodiment.

With reference to FIGS. 1-4, an overall construction of a watercraft 30 and an outboard motor 32 together having a hybrid control system 33 that is configured in accordance with certain features, aspects and advantages of the present invention is described. The outboard motor 32 is a typical marine drive, and thus a preferred embodiment is described below in the context of an outboard motor. However, other marine drives, such as, for example, inboard drives and inboard/outboard drives (or stern drives), can be applied as the marine drive. Additionally, at least one of the inventions disclosed herein can be used with any type of system in which a user-controlled input device can communicate electronically or mechanically with another part of the system.

The watercraft 30 has a hull 34. The watercraft 30 carries the outboard motor 32 which has a propulsion device 36 and an internal combustion engine 38. The propulsion device 36 propels the watercraft 30 and the engine 38 powers the propulsion device 36.

The outboard motor 32 comprises a drive unit 40 that incorporates the propulsion device 36, the engine 38 and a bracket assembly 42. The bracket assembly 42 supports the drive unit 40 on a transom of the hull 34 so as to place the propulsion device 36 in a submerged position with the watercraft 30 resting on the surface of a body of water. The bracket assembly 42 preferably comprises a swivel bracket and a clamping bracket. The drive unit 40 is steerable and tiltable by the combination of the swivel and the clamping brackets.

As used through this description, the terms "forward," "forwardly" and "front" mean at or to the side where the bracket assembly 42 is located, and the terms "rear,"

"reverse," "backwards" and "rearwardly" mean at or to the opposite side of the front side, unless indicated otherwise or otherwise readily apparent from the context use.

The engine 38 is disposed atop the drive unit 40. The engine 38 preferably comprises a crankshaft 44 (FIG. 3) extending generally vertically. A driveshaft 46 coupled with the crankshaft 44, extends vertically through a housing of the drive unit 40 disposed below the engine 38. The housing of the drive unit 40 journals the driveshaft 46 for rotation. The crankshaft 44 drives the driveshaft 46.

The drive unit 40 also journals a propulsion shaft 48 for rotation. The propulsion shaft 48 extends generally horizontally through a lower portion of the housing. The driveshaft 46 and the propulsion shaft 48 are preferably oriented normal to each other (e.g., the rotation axis of propulsion shaft 48 is at 90° to the rotation axis of the driveshaft 46).

As used in this description, the term "horizontally" means that the subject portions, members or components extend generally parallel to the water line when the watercraft 30 is substantially stationary with respect to the water line and when the drive unit 40 is not tilted and is generally placed in the position shown in FIG. 1. The term "vertically", in turn, means that portions, members or components extend generally normal to those extending horizontally.

In the illustrated arrangement, the propulsion device 36 preferably includes the propulsion shaft 48 and a propeller 50 that is affixed to an outer end of the propulsion shaft 48. The propulsion device 36, however, can take the form of a dual, a counter-rotating system, a hydrodynamic jet, or any of a number of other suitable propulsion devices. The driveshaft 46 preferably drives the propulsion shaft 48 through a transmission 52 that preferably comprises forward and reverse bevel gears.

A shift mechanism associated with the transmission 52 changes the transmission 52 among forward, reverse and neutral positions so as to set the propeller in forward, reverse or neutral modes. The shift mechanism preferably comprises a dog clutch unit that selectively engages the bevel gears to establish a meshed connection between the drive and propulsion shafts 46, 48 in the forward and reverse positions and disengages the bevel gears to release the propulsion shaft 48 from the drive shaft 46 in the neutral position.

The shift mechanism can also comprise a shift rod or shift member that has a shift cam coupled with a cam follower attached to the clutch unit. A pivotal movement of the shift rod can engage or disengage the clutch unit with the bevel gears though the combination of the shift cam and the cam follower. In the forward mode, the propeller 50 rotates, for example, in a right rotational direction that propels the watercraft 30 forwardly. In the reverse mode R, the propeller 50 rotates, for example, in a reverse rotational direction that propels the watercraft 30 backwards. In the neutral mode N, the propeller 50 does not rotate and does not propel the watercraft 30.

The shift rod is a change element that changes an operational condition of the outboard motor 32 in this embodiment, because the shift rod changes the propulsion mode of the propeller as a member of the shift mechanism. Preferably, a shift actuator is provided to actuate the shift rod. An electronic control unit (ECU) 53 (FIG. 2) controls the shift actuator.

The shift mechanism is disclosed in, for example, a co-pending U.S. application Ser. No. 10/689,343, titled SHIFT DEVICE FOR MARINE TRANSMISSION, the entire content of which is hereby expressly incorporated by reference.

A protective cowling assembly 54 preferably surrounds the engine 38. The protective cowling assembly 54 comprises a bottom cowling 56 (FIGS. 3 and 4) and a top cowling 58. The bottom cowling 56 is affixed to a top portion of the housing. The bottom cowling 56 has an opening through which an upper portion of the housing or an exhaust guide member extends. The bottom cowling 56 and the upper portion of the housing together form a tray. The engine 38 is placed onto this tray and is affixed to the upper portion of the housing.

The top cowling 58 preferably is detachably affixed to the bottom cowling 56 by a coupling mechanism so that a user, operator, mechanic or repairperson can access the engine 38 for maintenance or for other purposes. The top cowling 58 preferably has an air intake opening 60 (FIG. 4) through which ambient air is drawn into a closed cavity that is defined around the engine 38 by the cowling assembly 54.

Any type of conventional engine can be used as the engine 38. The engine 38 in the illustrated arrangement is a V-configured multiple cylinder engine. The engine 38 has an engine body 64 that comprises a cylinder block 66, cylinder heads 68 and a crankcase 70.

Figure 3:
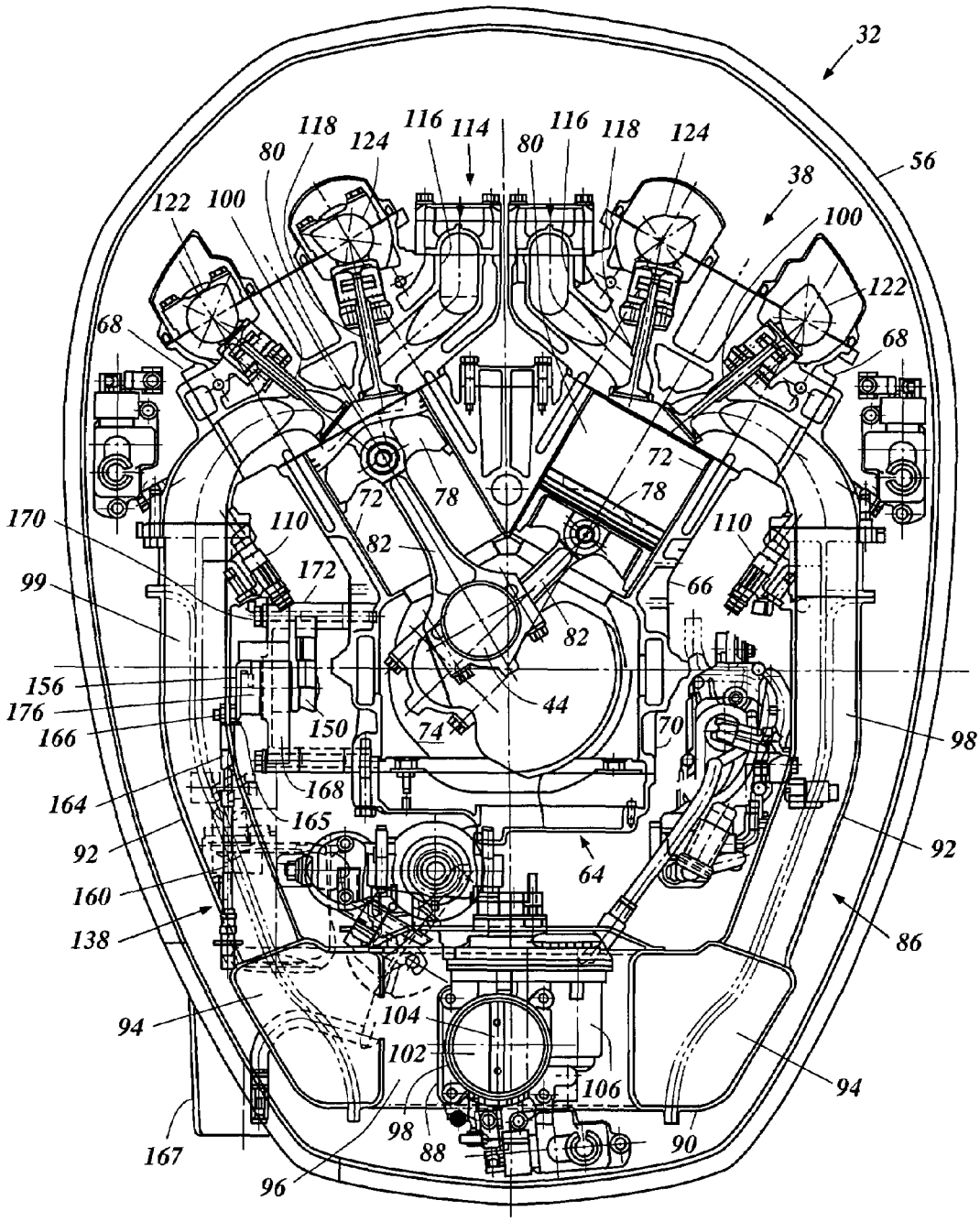
FIG. 3 illustrates a top plan and partial sectional view of an outboard motor of the watercraft of FIG. 1, a top cowling thereof removed.
Figure 4:
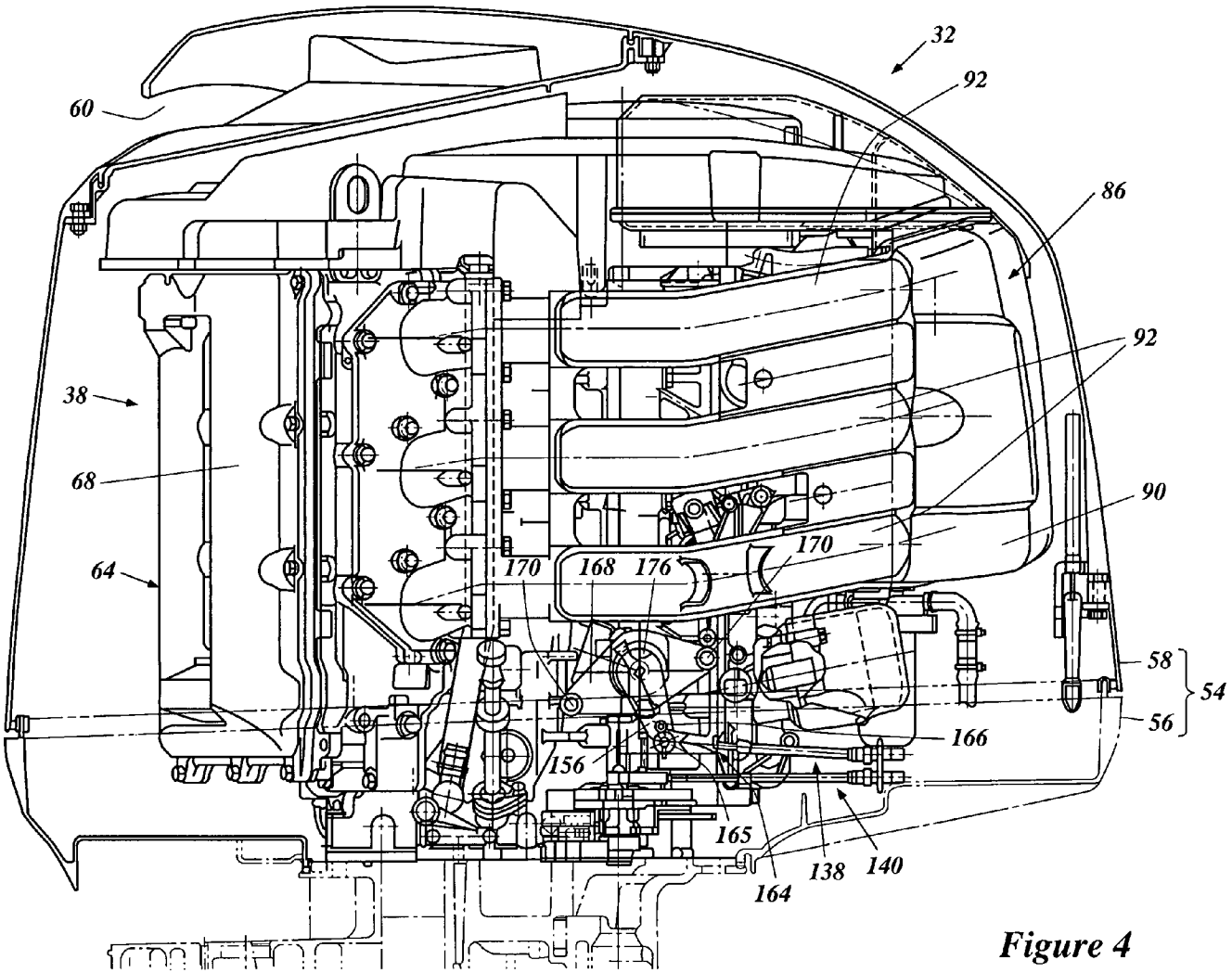
FIG. 4 illustrates a side elevational view of the outboard motor of FIG. 3, both the top cowling and a bottom cowling shown in cross section.

With continued reference to FIGS. 3 and 4, the cylinder block 66 defines a plurality of cylinder bores 72 that generally extend horizontally and are spaced apart vertically from one another. The cylinder bores 72 are bifurcated from one end of the cylinder block 66 to form two banks.

The crankcase 70 is affixed to the end of the cylinder block 66 to form a crankcase chamber 74. The crankshaft 44 is journaled within the crankcase chamber 74 for rotation.

A piston 78 is reciprocally disposed in each cylinder bore 72. Each cylinder head 68 is affixed to another end of the cylinder bores 72 on each bank and defines a combustion chamber 80 together with the associated cylinder bores 72 and pistons 78. The crankshaft 44 is connected to the pistons 78 through connecting rods 82. The crankshaft 44 thus rotates when the pistons 78 reciprocate within the cylinder bores 72.

An air intake system 86 is provided to draw the air around the engine 38 and delivers the air to the combustion chambers 80. The intake system 86 preferably comprises a throttle body 88, a plenum chamber member 90 and air intake conduits 92.

The plenum chamber member 90 is disposed in front of the engine body 64 and defines a plenum chamber 94 therein. The plenum chamber member 90 preferably has a recessed portion 96 in a top surface area thereof. The throttle body 88 preferably is placed in the recessed portion 96. The throttle body 88 has an air passage 98 extending generally vertically and connected to the plenum chamber 94 at its bottom.

Some of the intake conduits 92 preferably extend from the plenum chamber member 90 to one of the cylinder head 68 along a side surface of the engine body 64 on the starboard side. The rest of the intake conduits 92 extend from the plenum chamber member 90 to the other cylinder head 68 along a side surface of the engine body 64 on the port side. The intake conduits 92 together with the cylinder heads 68 define air intake passages 99 that connect the plenum chamber 94 to the combustion chambers 80. The air thus can be delivered to the respective combustion chambers 80 through the air passage 98 of the throttle body 88, the plenum chamber 94 and the intake passages 99. An intake valve 100 preferably is disposed at an intake port of each combustion chamber 88 to selectively open and close the intake port.

The throttle body 88 preferably has a throttle valve 102 that regulates an amount of the air to the combustion chambers 88 or an airflow rate within the air passage 98. The throttle valve 102 is an element that changes an operational condition of the outboard motor 30. For example, in this embodiment, the throttle valve 102 changes output of the engine 38; the greater the opening amount of the throttle valve 38, the higher the power output of the engine 38.

In the illustrated embodiment, the throttle valve 102 is a butterfly type valve and has a valve shaft 104 that is journaled for pivotal movement. Thus, the throttle valve 102 regulates the air amount in accordance with an angular position or open degree of the throttle valve 102. A throttle valve actuator 106 (FIG. 2) actuates the throttle valve 102 to move between a generally fully closed position and a fully open position under control of the ECU 53 as discussed below. Unless the environmental circumstances change, an engine speed of the engine 88 increases generally along the increase of the air amount or airflow rate. In other words, the output of the engine 88 increases when the air amount or airflow rate increases.

A fuel supply system such as, for example, a fuel injection system preferably supplies fuel also to the combustion chambers 80 to form air/fuel charges in the combustion chambers 80. In the illustrated arrangement, a fuel injector 110 is disposed on each intake conduit 92 to spray the fuel into each intake passage 99.

The ECU 53 (FIG. 2) preferably controls an amount of the fuel such that an air/fuel ratio can be kept in a desired range. Other charge formers such as, for example, carburetors can replace the fuel injection system.

A firing device that has ignition elements (e.g., spark plugs) exposed into the combustion chambers 80 preferably ignites the air/fuel charges in the combustion chambers 80 under control of the ECU 53. Abrupt expansion of the volume of the air/fuel charges, which burn in the combustion chambers 80, moves pistons 78 to rotate the crankshaft 44. The crankshaft 44 thus drives the driveshaft 46.

An exhaust system 114 preferably is provided to route exhaust gases in the combustion chambers 80 to an external location of the outboard motor 32. An exhaust manifold 116 is connected to the combustion chambers 80 on each bank through internal exhaust passages formed within each cylinder head 68. A majority of the exhaust gases preferably are discharged to the body of water through exhaust sections defined within the housing of the drive unit 40. An exhaust valve 118 preferably is disposed at an exhaust port of each combustion chamber 88 to selectively open and close the exhaust port.

The engine 38 preferably has an intake camshaft 122 and an exhaust camshaft 124 for each bank. The camshafts 122, 124 extend generally vertically and are journaled on each cylinder head 68. The camshafts 122, 124 actuate the intake and exhaust valves 100, 118 to close or open the intake and exhaust valves 100, 118, respectively. The crankshaft 44 preferably has a drive pulley or sprocket while the camshafts 122, 124 have driven pulleys or sprockets. An endless transmitter such as, for example, a timing belt or timing chain is wound around the pulleys or sprockets. Thus, the crankshaft 44 drives the camshafts 122, 124 through the transmitter.

With reference to FIG. 1, the watercraft 30 has a remote controller or operative device 128 that comprises a mechanical junction box 130 and a remote control lever 132. The remote controller 128 is disposed in a cockpit 134 of the watercraft 30. A mechanical cable 138 extends between the control lever 132 and the outboard motor 32 through the mechanical junction box 130. The mechanical cable 138 is used to operate both the throttle valve 100 and the shift rod. The control lever 132 preferably is pivotally journaled on the junction box 130 and pivots back and forth when an operator operates the control lever 132.

Typically, a watercraft is assembled in a factory with an outboard motor and uses a mechanical control system. That is, the mechanical cable 138 is coupled with the valve shaft 104 of the throttle valve 100 through a throttle valve link which is mechanically structured. Also, the mechanical cable 138 is coupled with the shift rod of the shift mechanism through a shift link which is mechanically structured. A customer or user of the watercraft may want to customize the watercraft and the outboard motor to incorporate an electrical control system instead of the mechanical control system.

Figure 2:
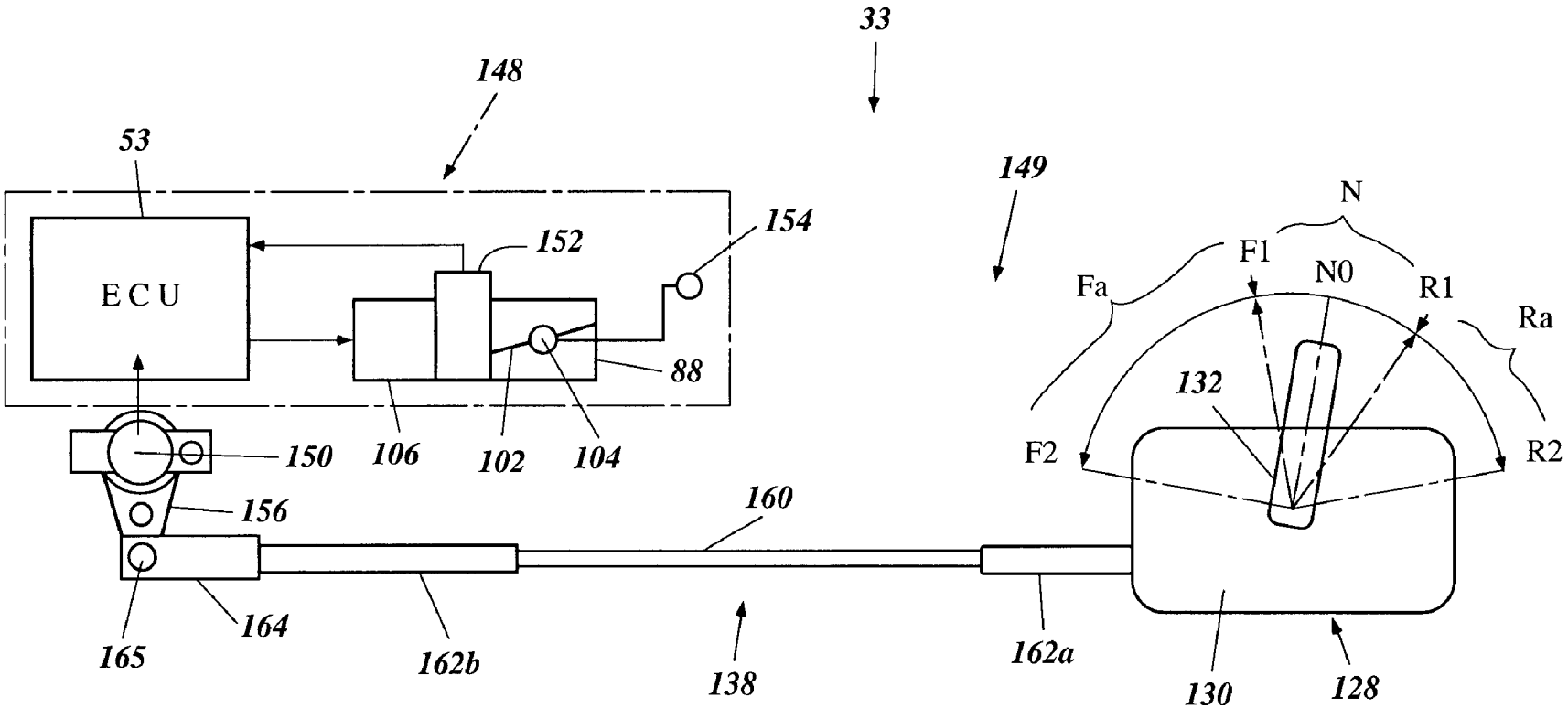
FIG. 2 illustrates a schematic representation of the hybrid control system included in the watercraft of FIG. 1.

With reference to FIG. 2, and as described above, the outboard motor 32 in this arrangement utilizes an electrical control system having an throttle valve actuator 106 that actuates the throttle valve 100 and an electronic shift actuator (not shown) that actuates the shift rod, which together form an electrical control set.

As noted above, the watercraft 30 is fitted with the mechanical control system using the remote controller 128 and the mechanical cable 138, which together form a mechanical control unit. In order to combine the electrical control set of the outboard motor 32 with the mechanical control unit of the watercraft 30, normally the user should replace the mechanical cable 138 with an electrical wire and a control lever position sensor that can provide a position of the control lever 132 to the ECU 53 through the wire. However, labor for changing components of the mechanical control unit to those of the electrical control unit is burdensome for the user. Also, such an exchange can be expensive. The hybrid control system 33 is the more convenient for a user who wishes to convert a watercraft, such as the watercraft 30, to use an electronic control system. Although this situation is one exemplary situation in which the hybrid system 33 is beneficial, the hybrid system 33 can also provide advantages in other situations and/or for other products.

With reference to FIGS. 2-4, the hybrid control system 33 is described in greater detail below.

The hybrid control system 33 preferably comprises the electrical control set, identified generally by the reference numeral 148 of FIG. 2, and a potentiometer or signal generator 150. The illustrated electrical control set comprises the ECU 53, the throttle valve actuator 106 and a throttle valve position sensor 152. Additionally, the remote controller 128 and the mechanical cable 138 in the illustrated embodiment together form a mechanical control unit 149.

The ECU 53 preferably comprises a microprocessor which is a central processor unit (CPU), one or more storage or memory units, input and output units and internal interfaces that connect those units. The throttle valve actuator 106 preferably is an electric motor or servomotor. However, other actuators can be used. The throttle valve actuator 106 can be in the form of an electric motor with a shaft that rotates about an axis. The shaft preferably is coupled with the valve shaft 104 through a linkage that can include a gear train (not shown).

The ECU 53 controls the valve actuator 106 using a throttle valve control command provided through the remote controller 128 and the potentiometer 150. Preferably, the valve actuator 106 moves the throttle valve 104 between the generally closed position and the open position under control of the ECU 53.

In operation, the throttle valve position sensor 152 senses an actual position of the throttle valve 100 and sends a throttle valve position signal to the ECU 53. The ECU 53 determines whether the actual throttle valve position sensed by the throttle valve position sensor 152 is consistent with the throttle valve control command. If the sensed position is inconsistent with the control command, the ECU 53 further moves the throttle valve 102 through the throttle valve actuator 106 until the sensed position becomes consistent with the control command. That is, the ECU 53 makes a feedback control onto the throttle valve actuator 106 based upon the throttle valve control command.

Preferably, an auxiliary throttle valve lever 154 is coupled with the valve shaft 104 such that the operator can manually actuate the throttle valve 102 in the event that the remote control lever 132 cannot be normally operated.

Although not shown, preferably the electrical control set 148 further comprises the shift actuator, a shift position sensor and an emergency shift control lever. The shift actuator preferably is an electric motor, a servomotor, or any other suitable actuator. The shift actuator, i.e., the electric motor has a shaft that rotates about an axis of the shaft. The shaft preferably is coupled with the shift rod through a linkage that can include a gear train.

Similarly to the throttle valve control, the ECU 53 controls the shift actuator using a shift control command provided also through the remote controller 128. Both of the throttle valve control command and the shift control command is given by the same type of signal. Preferably, the ECU 53 differs those commands from each other by the voltage, for example, that the potentiometer 150 generates corresponding to each position of the remote control lever 132. The shift actuator moves the shift rod so as to set the propeller 50 among the forward, reverse and neutral modes. The shift position sensor senses an actual shift position of the shift rod and sends a shift position signal to the ECU 53.

The ECU 53 is configured to determine whether the actual shift position sensed by the shift position sensor is consistent with the shift control command. If the sensed position is inconsistent with the shift control command, the ECU 53 further moves the shift rod through the shift actuator. That is, the ECU 53 makes a feedback control onto the shift actuator based upon the shift control command.

The potentiometer 150 is a device that has an input shaft journaled on a housing of the potentiometer 150 for pivotal movement and generates a signal in response to an angular position of the input shaft. The potentiometer 150 is connected to the ECU 53 through an electric wire. The electric wire has one end that extends to the potentiometer 150 and another end that extends to the ECU 53. Each end preferably has a coupler or connector which is detachably coupled with the counterpart. The generated signal is provided to the ECU 53 so as to be used for the control of the throttle valve actuator 106 and also for the control of the shift actuator.

The input shaft of the potentiometer 150 has an input lever 156 that can be coupled with the mechanical cable 138. The mechanical cable 138 preferably is a push-pull cable that comprises an inner wire 160 and two outer sheathes 162*a*, 162*b* disposed on both ends of the inner wire 160, one outer sheath 162*a* affixed to a housing of the remote controller 128 and the other outer sheath 162*b* affixed to the engine body 64. In some embodiments, the outer sheath 162*b* can be affixed to the bottom cowling 56.

One end of the inner wire 160 preferably is coupled with the remote control lever 132. The other end of the inner wire 160 is detachably coupled with the input lever 156 via a joint member 164. That is, the joint member 164 has an opening while the input lever 156 has a shaft 165 that passes through the opening.

A clip 166 is affixed to a tip of the shaft 165 after the shaft 165 extends through the opening to prevent the shaft 165 from slipping off the opening. The inner wire 160 thus can reciprocally move relative to the outer sheathes 162*a*, 162*b* when the control lever 132 pivotally moves relative to the housing of the remote controller 128. The sheathes 162*a*, 162*b* can be connected with each other to entirely cover the inner wire 160.

With reference to FIGS. 3 and 4, in the illustrated arrangement, the bottom cowling 56 has a tubular projection 167 through which the inner cavity of the protective cowling assembly can communicate outside. The mechanical cable 138 passes through the tubular projection 167 to connect the remote control lever 132 and the input lever 156 of the potentiometer 150.

A bracket 168, which has a plate shape, preferably is disposed at a side surface of the engine body 64 on the port side. The bracket 168 preferably has two bolt holes at ends thereof opposing to each other. The bracket 168 is affixed to the side surface of the engine body 64 by bolts 170 via collars 172. The potentiometer 150 preferably is affixed to one surface of the bracket 168 that faces the engine body 64. The bracket 168 has an opening and the input shaft passes through the opening such that an axis thereof extends generally horizontally. A relatively large diameter member 176 is coupled with the input shaft on the other side of the bracket 168 and rotates when the input shaft rotates. The input lever 156 is detachably affixed to the large diameter member 176 so as to rotate with the large diameter member 176 and thus with the input shaft.

With reference to FIG. 2, the remote control lever 132 is operable by the operator so as to pivot between two limit ends F2 and R2. A forward acceleration range Fa, a forward troll position F1, a neutral range N, a reverse troll position R1 and a reverse acceleration range Ra can be selected in this order between the limit ends F2 and R2. The forward acceleration range Fa is a range extending between the limit end F2 and the forward troll position F1. The forward limit end F2 is a maximum acceleration position of the forward acceleration range.

Similarly, the reverse acceleration range Ra is a range extending between the reverse troll position R1 and the other limit end R2. The reverse limit end R2 is a maximum acceleration position of the reverse acceleration range Ra. The forward troll position F1 is consistent with a minimum acceleration position of the forward acceleration range, while the reverse troll position R1 is consistent with a minimum acceleration position of the reverse acceleration range.

Preferably, the engine 38 operates at idle speed when the forward or reverse troll position F1, R1 is selected, and the propeller 50 rotates slowly to propel the watercraft 30 when the engine 38 operates at idle.

The propeller 50 is set to the forward mode while the control lever 132 is placed between the forward troll position F1 and the limit end F2. On the other hand, the propeller 50 is set to the reverse mode while the control lever 132 is placed between the reverse troll position R1 and the limit end R2. A neutral position N0, where the propeller 50 is set to the neutral mode, is located between the forward troll position F1 and the reverse troll position R1. However, the dog clutch unit does not engage with either the forward or reverse bevel gear within the neutral range N and thus the propeller 50 is held in the neutral mode unless the control lever 132 reaches or exceeds the forward or reverse troll position F1, R1. In addition, the control lever 132 preferably stays at any position between the limit ends R2 and F2 unless the operator moves the lever 132.

Initially, the control lever 132 is placed at the neutral position N0. Thus, the throttle valve 100 is substantially closed and the engine 38 operates at idle. Also, the shift mechanism is placed at the neutral position to set the propeller 50 to the neutral mode. The operator starts moving the control lever 132 toward, for example, the forward troll position F1. Before reaching the forward troll position F1, the throttle valve 100 is kept at the substantially closed position and the shift mechanism also is kept at the neutral position. When the control lever 132 exceeds the forward troll position F1, the potentiometer 150 provides a throttle valve control command in response to a position of the control lever 132 in the forward acceleration range Fa. The ECU 53 then controls the throttle valve actuator 106 to place the throttle valve 104 to a position that corresponds to the throttle valve control command. In other words, the ECU 53 continues operating the throttle valve actuator 106 until the throttle valve position signal sensed by the throttle valve position sensor 152 becomes consistent with the throttle valve control command. Similarly, the ECU 53 controls the throttle valve actuator 106 when the operator moves the control lever 132 in the reverse acceleration range Ra.

On the other hand, when the control lever 132 reaches and exceeds, for example, the forward troll position F1, the potentiometer 150 provides a shift control command in response to a position of the control lever 132 in the forward acceleration range Fa including the forward troll position F1. The ECU 53 then controls the shift actuator to set the propeller 50 to the forward mode through the shift mechanism in accordance with the shift control command. Similarly, the ECU 53 controls the shift actuator when the operator moves the control lever 132 in the reverse acceleration range Ra including the reverse troll position R2.

By incorporating the potentiometer 150, in the illustrated arrangement, the hybrid control system 33 can be easily applied to any outboard motors that have an electrical control set 148 that fits the electrical control system even though an associated watercraft has the mechanical control unit 149 that fits the mechanical control system.

Also, the potentiometer 150 can be easily removed together with their own brackets, input levers and mechanical cable if a watercraft is equipped with the electrical control set that is adapted to the electrical system 148. The potentiometer 150 can remain in the electrical control set without the mechanical cable if it is appropriate in sales of the watercraft and the outboard motor. The brackets and/or the input levers can remain with the potentiometer 150.

Figure 5:
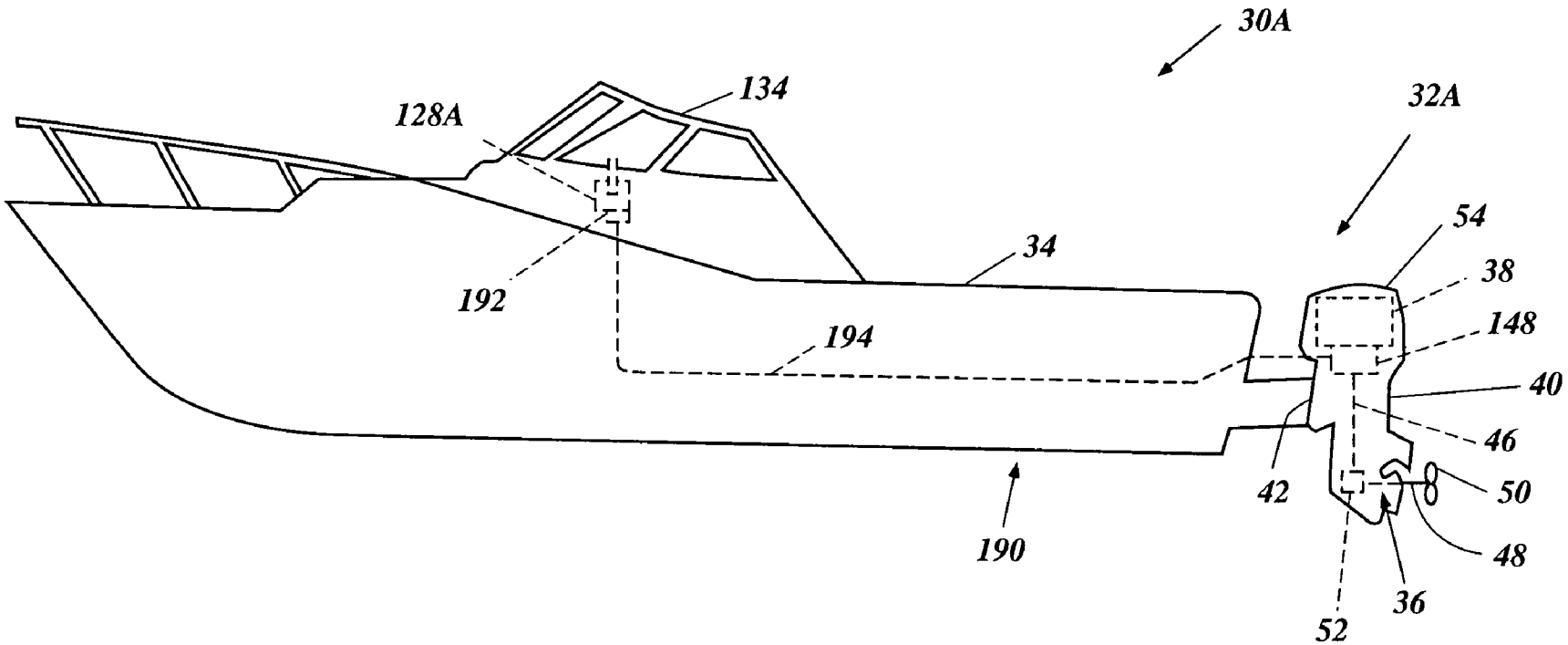
FIG. 5 illustrates a schematic representation of a port side elevational view of another watercraft that has an electrical control system.
Figure 6:
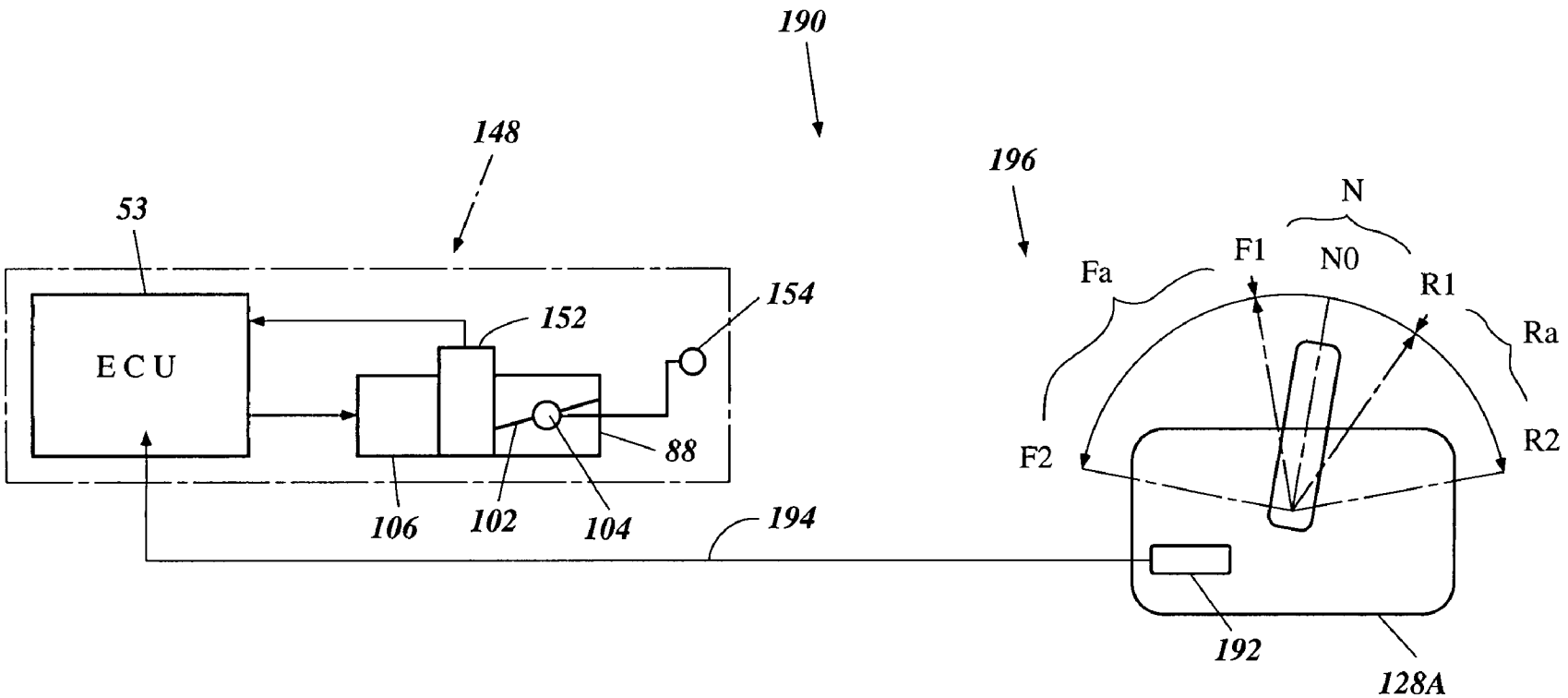
FIG. 6 illustrates a schematic representation of the electrical control system included on the watercraft of FIG. 5.

With reference to FIGS. 5 and 6, a watercraft 30A is equipped with the electrical control system, which now is identified generally by the reference numeral 190. The devices, components, members and portions thereof that have been described above are assigned with the same reference numerals or symbols and are not described repeatedly. Also, modified devices, components, members and portions thereof are assigned with the same reference numerals or symbols that are followed by the letter "A" and are not described further or not described in detail.

The watercraft 30A has a modified remote controller 128A that comprises a housing and a lever position sensor or lever position sensing device 192 that is disposed in the housing and senses a position of a remote control lever 132. An electric wire 194 is connected to the ECU 53 of the electrical control set 148 to provide a command signal that corresponds to the position of the control lever 132. The electric wire 194 preferably has a coupler or connector that can be coupled to the coupler or connector of the ECU 53. The remote controller 128A and the electric wire 194 in this arrangement together form an electrical control unit 196 or an "electric remote device". The ECU 53 controls the throttle valve actuator 106 and the shift actuator (not shown) based upon the command signal.

In one variation, a set of wireless transmitter and receiver can replace the electric wire 194. In another variation, the remote controller 128A can have an own control device that is connected to the ECU 53 through a local area network (LAN) or the like instead of the electric wire 194.

Figure 7:
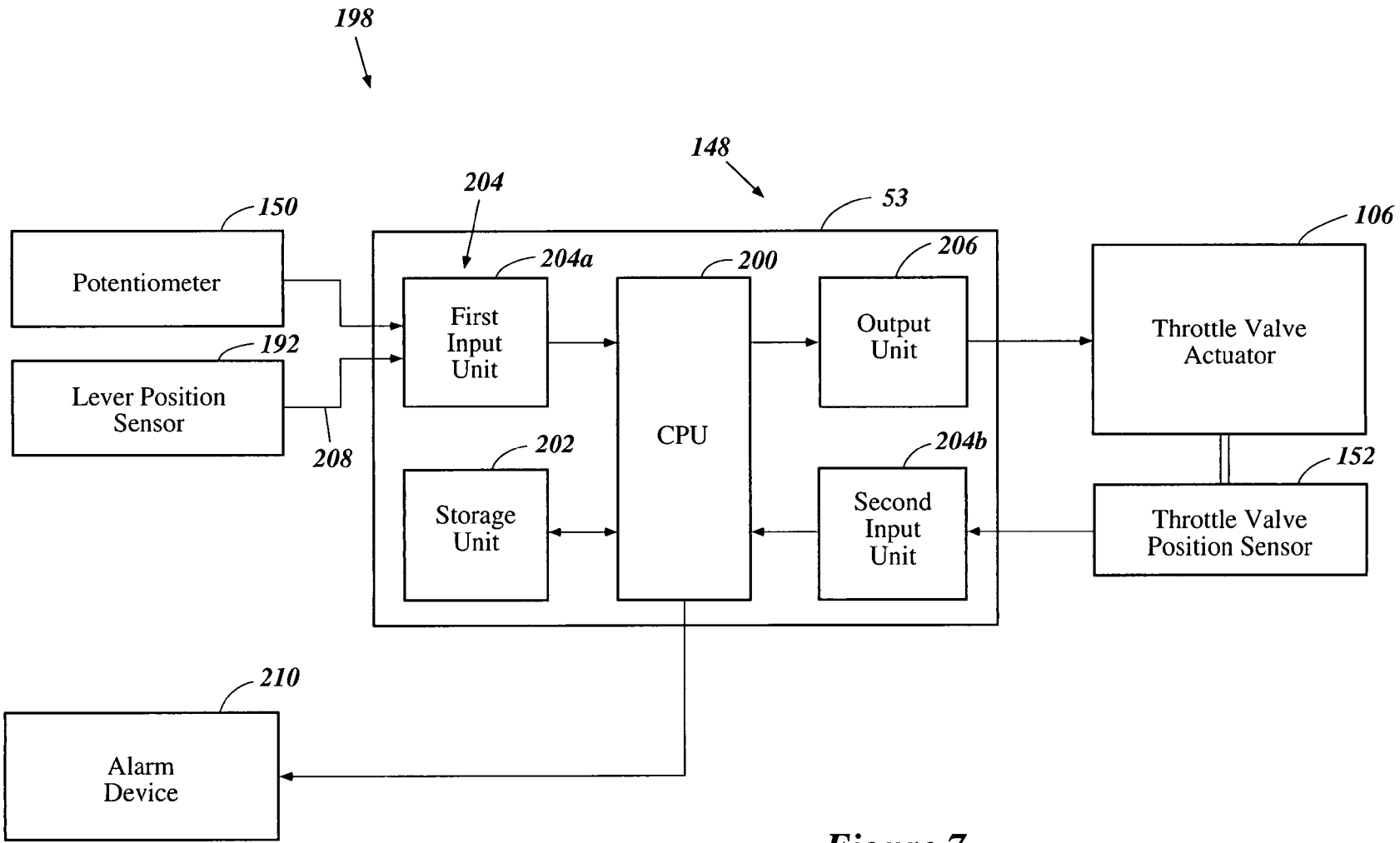
FIG. 7 illustrates a block diagram showing a hybrid control system configured in accordance with certain features, aspects and advantages of an embodiment.
Figure 8:
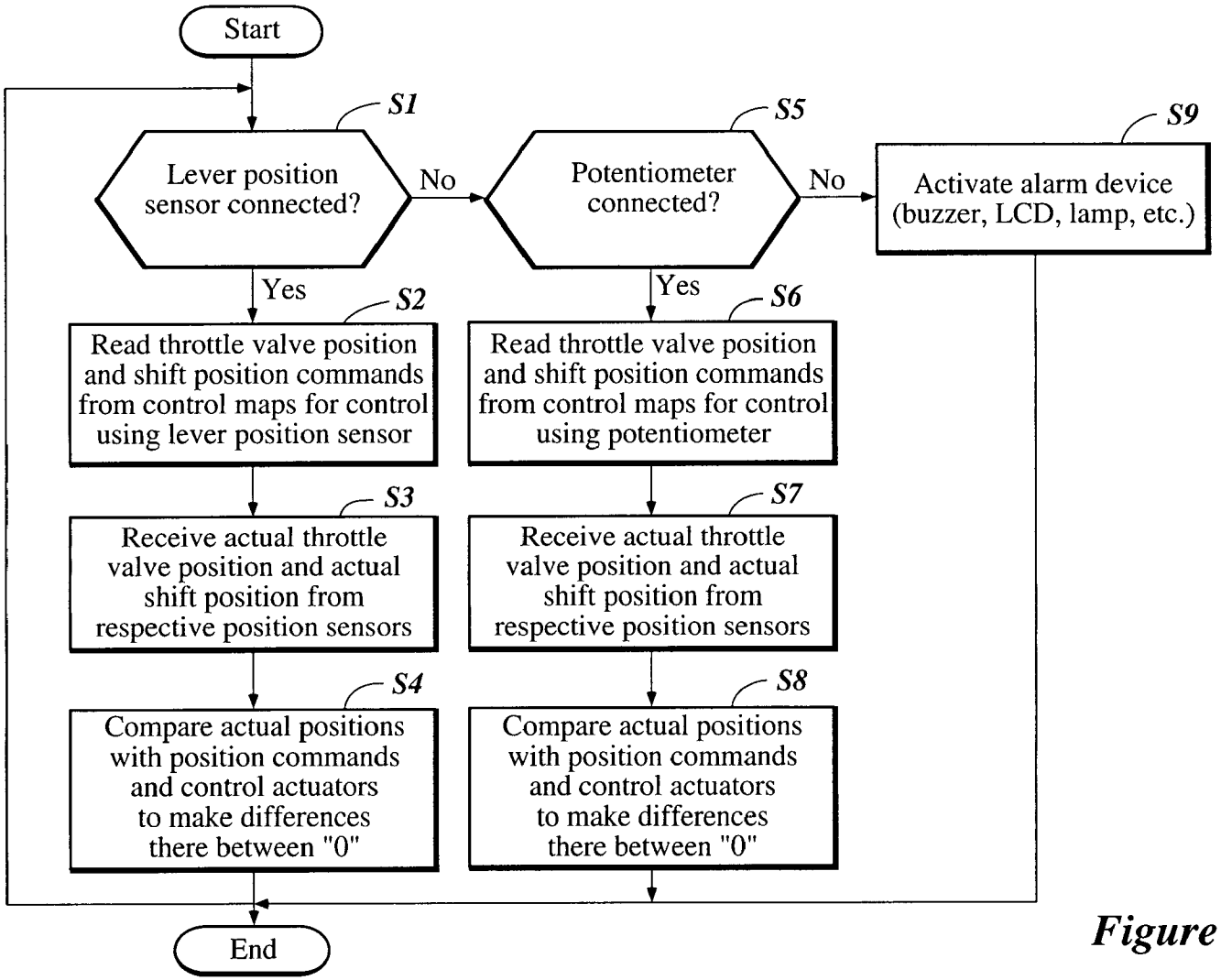
FIG. 8 illustrates a flow chart of a control program which can be used in conjunction with the control system of FIG. 7.

With reference to FIGS. 7 and 8, a changeable control system 198 configured in accordance with certain features, aspects and advantages of the present invention is described below. As noted above, the devices, components, members and portions thereof that have been described above are assigned with the same reference numerals or symbols and are not described repeatedly. The changeable control system 198 can be changed to the hybrid control system 33 or the electrical control system 190 in accordance with the user's selection and thus can be applied to both of the watercraft 30 and the watercraft 30A.

With initial reference to FIG. 7, the changeable control system 198 includes the electrical control set 148. The ECU 53 of the electrical control set 148 preferably comprises the CPU 200, the storage unit 202, the input units 204 and the output unit 206 as noted above.

The illustrated input units 204 comprise a first input unit 204*a* and a second input unit 204*b*. The potentiometer 150 and the lever position sensor 192 can be selectively connected to the first input unit 204*a* through each electric wire 208. The first input unit 204*a* preferably has at least one connector or coupler for easy instillation and removal of the potentiometer 150 or the lever position sensor 192. Either the potentiometer 150 or the position sensor 192 is connected to the connector. In one variation, the first input unit 204*a* can have a plurality of connectors each exclusively suits each one of the potentiometer 150 and the position sensor 192. The first input unit 204*a* transfers the command signal from the potentiometer 150 or the position sensor 192 to the CPU 200.

Preferably, the potentiometer 150 and the position sensor 192 have their own identification numbers and provide respective identification signals corresponding to the identification numbers to the CPU 200 through the input unit 204*a*. The CPU 200 can recognize which one of the potentiometer 150 and the position sensor 192 is connected to the first input unit 204*a* based upon the identification signals. A method for recognizing which device is coupled to is disclosed in, for example, a co-pending U.S. application Ser. No. 10/619,095, titled MULTIPLE NODE NETWORK AND COMMUNICATION METHOD WITHIN THE NETWORK, the entire content of which is hereby expressly incorporated by reference.

The throttle valve position sensor 152 and the shift position sensor are connected to the second input unit 152, although the shift position sensor is not shown. The second input unit 204*b* transfers the position signals from the throttle valve position sensor 152 and the shift position sensor to the CPU 200.

The output unit 206 is connected to the throttle valve actuator 106 and the shift actuator, although the shift actuator is not shown. The CPU 200 controls the throttle valve actuator 106 and the shift actuator through the output unit 206.

The storage unit 202 preferably stores at least one control program. The CPU 200 controls the throttle valve actuator 106 and the shift actuator using the control program. Also, the storage unit 202 preferably stores plurality groups of control maps. One group of the control maps is suitable to control the throttle valve actuator 106 and the shift actuator based upon the command signal from the potentiometer 150. One control map of this group has a plurality of throttle valve positions each corresponding to each one of the throttle valve position commands. Another control map of this group has the propulsion modes each corresponding to each one of the shift position commands. Another one group of the control maps is suitable to control the throttle valve actuator 106 and the shift actuator based upon the command signal from the position sensor 192. This group of control maps also includes similar control maps each having the throttle valve positions or the propulsion modes. In one variation, if each command signal from the potentiometer 150 or the position sensor 192 is the same as one another and indicates a position of the control lever 132 in the same way as one another, no need exists to change control maps.

The changeable control system 198 preferably has an alarm device or indicator 210 connected to the CPU 200. The alarm device 210 can provide audible indication (i.e., sound) and/or visual display if none of the potentiometer 150 and the position sensor 192 is connected to the first input unit 204*a* immediately after a main switch is activated or within a preset time after the main switch is activated. For example, a set of a buzzer and a liquid crystal digital (LCD) panel or an individual buzzer or LCD panel can form the alarm device 210. In some alternatives, a lamp that has yellow, red or other colors, for example, can replace the LCD panel. The main switch preferably is a power switch through which the electric power is supplied to all the electrical devices and components of the watercraft that incorporates the changeable control system 198.

In the illustrated second embodiment, at least the remote controller 128, the mechanical cable 138 and the potentiometer 150 together form a first operative arrangement. Also, the remote controller 128A including the lever position sensor 192 and the electric wire 194 together form a second operative arrangement.

With reference to FIG. 8, the changeable control system 198 can utilize a control program 214 to control the throttle valve actuator 106 and the shift actuator. In the illustrated embodiment, the changeable control system 198 is changed to either the hybrid control system 33 or the electrical control system 190 in accordance with a determination whether the lever position sensor 192 or the potentiometer 150 is connected to the first input unit 204*a*.

When the main switch is activated, the electric power is supplied to the changeable control system 198. The control program 214 proceeds to a step S1 to determine whether the lever position sensor 192 is connected to the first input unit 204*a*. For example, the CPU 53 can determine based upon the identification signal provided by the position sensor 192 or the potentiometer 150. If the determination is positive, the program 214 goes to a step S2 and the changeable control system 198 acts as the electrical control system 190 from now on.

At the step S2, the CPU 200 receives a command signal from the lever position sensor 192. The CPU 200 reads a throttle valve position command and a shift position command corresponding to the command signal from the control maps that are adapted to the lever position sensor 192 and stores the throttle valve position and the shift position in each storage area of the storage unit 202. The program 214 then goes to a step S3.

At the step S3, the CPU 200 receives an actual throttle valve position signal from the throttle valve position sensor 152 and stores the actual throttle valve position in an actual throttle valve position storage area of the storage unit 202. Also, the CPU 200 receives an actual shift position signal indicative of an actual position of the shift rod from the shift position sensor and stores the shift position in an actual shift position storage area of the storage unit 202. Then, the program 214 goes to a step S4.

The CPU 200, at the step S4, reads the throttle valve command and the actual throttle valve position in the respective storage areas of the storage unit 202 and compares the throttle valve position command and the actual throttle valve position. The CPU 200 controls the throttle valve actuator 106 to move the throttle valve 102 until the actual position becomes consistent with the position command unless the actual position is consistent with the position command. Also, the CPU 200, at the step S4, reads the shift command and the actual shift position of the shift rod in the respective storage areas of the storage unit 202 and compares the shift position command and the actual shift position. The CPU 200 controls the shift actuator to move the shift rod until the actual position becomes consistent with the position command unless the actual position is consistent with the position command. The program 214 returns back to the step S1 after the step S4.

If the determination at the step S1 is negative, i.e., the lever position sensor 192 is not connected to the first input unit 204*a*, the program 214 goes to a step S5. At the step S5, the control program 214 determines whether the potentiometer 150 is connected to the first input unit 204*a*. If the determination is positive, the program 214 goes to a step S6 and the changeable control system 198 acts as the hybrid control system 33.

The CPU 200, at the step S6, receives a command signal from the potentiometer 150. The CPU 200 reads a throttle valve position command and a shift position command corresponding to the command signal from the control maps and stores the throttle valve position and the shift position in each command storage area of the storage unit 202. The program 214 then goes to a step S7.

At the step S7, the CPU 200 receives an actual throttle valve position signal from the throttle valve position sensor 152 and stores the actual throttle valve position in the actual throttle valve position storage area of the storage unit 202. Also, the CPU 200 receives an actual shift position signal indicative of an actual position of the shift rod from the shift position sensor and stores the shift position in the actual shift position storage area of the storage unit 202. Then, the program 214 goes to a step S8.

The CPU 200, at the step S8, reads the throttle valve command and the actual throttle valve position in the respective storage areas of the storage unit 202 and compares the throttle valve position command and the actual throttle valve position. The CPU 200 controls the throttle valve actuator 106 to move the throttle valve 102 until the actual position becomes consistent with the position command unless the actual position is consistent with the position command. Also, the CPU 200, at the step S8, reads the shift command and the actual shift position of the shift rod in the respective storage areas of the storage unit 202 and compares the shift position command and the actual shift position. The CPU 200 controls the shift actuator to move the shift rod until the actual position becomes consistent with the position command unless the actual position is consistent with the position command. The program 214 then returns back to the step S1.

If the determination at the step S5 is negative, i.e., the potentiometer 150 is not connected to the first input unit 204*a*, the program 214 goes to a step S9. The CPU 200 activates the alarm device 210 at the step S9. The alarm device 210 alerts the user that neither the potentiometer 150 nor the lever position sensor 192 is connected to the first input unit 204*a* using sound or a visual indication. The alarm device 210 can work under other conditions including abnormal conditions. For example, the alarm device 210 works when the electric wire 208 comes off from the connector of the first input unit 204*a* or when the electric wire 208 is broken. The program 214 returns back to the step S1 after activating the alarm device 210. If the lever position sensor 192 or the potentiometer 150 is still absent from the first input unit 204*a*, the alarm device 210 continues to alert. The control program 214 ends when the main switch is deactivated.

In one variation, at both the steps S4 and S8, the CPU 200 can control the throttle valve actuator 106 to move the throttle valve 102 with a preset amount so as to approach the target position by repeating the steps S1-S4 or steps S1 and S5-S8.

As thus described, the operator or user can easily select the hybrid control system or the electrical control system in accordance with the second embodiment.

In some embodiments, the movement of the input lever 156 is not necessarily consistent with the movement of the remote control lever 132 and can vary non-linearly relative to the movement of the remote control lever 132. This is because the control maps can involve necessary adjustments based upon results of previous experiments or the like.

In some embodiments, the electrical control set 148 can have a special control device that controls the throttle valve actuator and the shift actuator, instead of the ECU 53, which controls the engine operation also.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. It is also contemplated that various combinations or sub-combinations of the specific features and aspects of the embodiments may be made and still fall within the scope of the invention. It should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above, but should be determined only by a fair reading of the claims.

What is claimed is:

1. A control system for an outboard motor comprising a change element disposed in the outboard motor and configured to change an operational condition of the outboard motor, an actuator disposed in the outboard motor and configured to actuate the change element, a control device disposed in the outboard motor and configured to control the actuator, a first signal generator disposed in the outboard motor and configured to convert physical movement to a first command signal and to output the first command signal to the control device, the first signal generator being configured to be mechanically connectable to a mechanical remote control device such that physical movement of the remote control device causes physical movement of a part of the first signal generator, the control device also being configured to be connectable to an electronic remote control device having a second signal generator configured to detect movement of a remote control lever and to output a second command signal, the control device being further configured to determine whether the first signal generator is connected to the control device and whether the electronic remote control device is connected to the control device, the control device also being configured to control the actuator based upon the second command signal from the electronic remote device if the first signal generator is not connected to the control device.

2. The control system as set forth in claim 1, wherein the marine drive has an engine and a propulsion device powered by the engine, the engine has a throttle valve that regulates an amount of air to a combustion chamber of the engine, the change element is the throttle valve, and the operational condition is an output of the engine.

3. The control system as set forth in claim 1, wherein the marine drive has an engine, a propulsion device powered by the engine, and a shift mechanism arranged to change a propulsion mode of the propulsion device, the change element being a member of the shift mechanism, and the operational condition is the propulsion mode of the propulsion device.

4. The control system as set forth in claim 1, wherein the first signal generator is configured to be connected to the mechanical remote control device with a push pull cable.

5. The control system as set forth in claim 1, wherein the mechanical remote control device is detachably coupled with the first signal generator.

6. The control system as set forth in claim 1, wherein the mechanical remote control device comprises a lever that is pivotable relative to a housing.

7. The control system as set forth in claim 6, wherein the first signal generator has a pivotable shaft, the lever being connectable with the shaft to pivot with the shaft.

8. The control system as set forth in claim 1, wherein the first signal generator has a pivotable shaft, the shaft being connectable with the mechanical remote control device.

9. The control system as set forth in claim 1, wherein the first signal generator is a potentiometer.

10. The control system as set forth in claim 1 additionally comprising a second operative device remotely placed from the control device, the second operative device having a third movable member and a position sensing device, the position sensor configured to output a second command signal to the control device in accordance with a position of the third movable member, the control device controls the actuator based upon either the first or second command signal.

11. The control system as set forth in claim 10, wherein the control device has an input unit, the first signal generator or the electronic remote control device being selectively coupled to the input unit.

12. A control system for an outboard motor having an engine comprising a throttle valve that regulates an amount of air to a combustion chamber of the engine, a throttle valve actuator arranged to actuate the throttle valve, a control device disposed in the outboard motor and configured to control the throttle valve actuator, an operative device remotely placed from the control device, the operative device having a first movable member, configured to be connectable to a second moveable member disposed remotely from the operative device with a mechanically connecting member having a plurality of ends, one end of the connecting member coupled with the first movable member and another end of the mechanically connecting member coupled with the second movable member, a signal generator disposed in the outboard motor and configured to output a first command signal to the control device based on a position of the second movable member, the movement of the second movable member being determined by the mechanically connecting member, the control device being configured to determine whether the signal generator is connected to the control device and to control the throttle valve actuator based upon a second command signal from an electronic remote device only if the signal generator is not connected to the control device.

13. The control system as set forth in claim 12, wherein the connecting member is detachably coupled with the second movable member.

14. The control system as set forth in claim 12, wherein the second movable member is detachably coupled with the signal generator.

15. The control system as set forth in claim 12, wherein the engine is disposed on the marine drive, the signal generator is affixed to the engine or the marine drive.

16. A control system for an outboard motor comprising a change element disposed in the outboard motor that changes an operational condition of the outboard motor, an actuator disposed in the outboard motor and arranged to actuate the change element, a control device disposed in the outboard motor and configured to control the actuator, a first operative assortment capable to communicate with the control device, the first operative assortment including a first operative device remotely placed from the control device, and a signal generator disposed in the outboard motor and configured to output a first command signal to the control device, the first operative device having a first movable member, a mechanically connecting member having a plurality of ends, one end of the connecting member coupled with the first movable member and another end of the mechanically connecting member coupled with a second movable member disposed remotely from the operative device, the signal generator generating the first command signal in accordance with a position of the second movable member, the position of the second movable member being determined by the mechanically connecting member, and a second operative assortment capable to communicate with the control device, the second operative assortment comprising a electronic remote device configured to send a second command signal to the control device, the control device being further configured to determine if the first operative assortment is connected to the control device and if the second operative assortment is connected to the control device, the control device being further configured to control the actuator based upon the second command signal if the fist operative assortment is not connected to the control device.

17. The control system as set forth in claim 16, wherein the control device has an input unit, the signal generator or the position sensing device is selectively connected to the input unit.

18. A control system for a marine drive comprising a change element that changes an operational condition of the marine drive, an actuator arranged to actuate the change element, a control device configured to control the actuator, a first operative assortment capable to communicate with the control device, the first operative assortment including a first operative device remotely placed from the control device, and a first signal generator configured to output a first command signal to the control device, the first operative device having a first movable member, a mechanically connecting member having a plurality of ends, one end of the connecting member coupled with the first movable member, the first signal generator having a second movable member, another end of the connecting member coupled with the second movable member, the second movable member moving along with the first movable member when the first movable member is operated, the first signal generator generating the first command signal in accordance with a position of the second movable member, and a second operative assortment capable to communicate with the control device, the second operative assortment including a second operative device that has a third movable member, and a position sensing device that senses a position of the third movable member, the position sensing device configured to output a second command signal to the control device, the first signal generator and the position sensing device selectively connected to the control device, the control device controlling the actuator based upon either the first or second command signal, wherein the control device has an input unit, the first signal generator or the position sensing device is selectively connected to the input unit the control system also includes a visual or audible indicator that indicates none of the first signal generator and the position sensing device is connected to the input unit.

* * * * *

UNITED STATES PATENT AND TRADEMARK OFFICE

CERTIFICATE OF CORRECTION

PATENT NO. : 7,524,222 B2
APPLICATION NO. : 10/795765
DATED : April 28, 2009
INVENTOR(S) : Katsumi Ochiai It is certified that error appears in the above-identified patent and that said Letters Patent is hereby corrected as shown below:

In Column 11, Line 59, please change “electric” to --electronic--.

In Column 16, Line 28, in Claim 10, please change “controls” to --being configured to control--.

In Column 17, Line 29, in Claim 16, please change “fist” to --first--.

Signed and Sealed this

Second Day of November, 2010

David J. Kappos

David J. Kappos
*Director of the United States Patent and Trademark Office*